US012467163B2

(12) United States Patent
Mathota et al.

(10) Patent No.: US 12,467,163 B2
(45) Date of Patent: Nov. 11, 2025

(54) COMPOSITE YARN

(71) Applicant: Ansell Limited, Richmond (AU)

(72) Inventors: Mathotarallage Amani Rasika Mathota, Kelaniya (LK); Andarage Naveen Pradeep Kumara, Embilipitiya (LK); Withanage Priyantha Kumara Withanage, Melsiripura (LK)

(73) Assignee: Ansell Limited, Victoria (AU)

( * ) Notice: Subject to any disclaimer, the term of this patent is extended or adjusted under 35 U.S.C. 154(b) by 0 days.

(21) Appl. No.: 18/595,131

(22) Filed: Mar. 4, 2024

(65) Prior Publication Data

US 2025/0277326 A1 Sep. 4, 2025

(51) Int. Cl.

| | |
|---|---|
| ***D02G 3/04*** | (2006.01) |
| ***D02G 3/36*** | (2006.01) |
| ***D02G 3/44*** | (2006.01) |

(52) U.S. Cl.

CPC ..... *D02G 3/045* (2013.01); *D02G 3/36* (2013.01); *D02G 3/441* (2013.01); *D02G 3/443* (2013.01); *D10B 2401/063* (2013.01)

(58) Field of Classification Search

CPC ..... D02G 3/04; D02G 3/045; D02G 3/047; D02G 3/16; D02G 3/18; D02G 3/38; D02G 3/441; D02G 3/442; D02G 3/443

See application file for complete search history.

(56) References Cited

U.S. PATENT DOCUMENTS

| | | | | |
|---|---|---|---|---|
| 4,265,082 | A | 5/1981 | Sasaki et al. | |
| 5,233,821 | A | 8/1993 | Weber | |
| 5,356,700 | A * | 10/1994 | Tanaka | D03D 15/00 428/920 |
| 5,721,179 | A | 2/1998 | Shi et al. | |
| 6,155,084 | A | 12/2000 | Andrews et al. | |
| 7,214,425 | B2 | 5/2007 | Kolmes et al. | |
| 7,762,053 | B2 | 7/2010 | Takada | |
| 8,302,374 | B2 | 11/2012 | Marissen et al. | |
| 8,671,462 | B2 | 3/2014 | Garcia et al. | |
| 11,047,069 | B2 | 6/2021 | Dapsalmon | |
| 11,306,418 | B2 * | 4/2022 | Stanhope | D03D 1/0035 |

(Continued)

FOREIGN PATENT DOCUMENTS

| | | |
|---|---|---|
| DE | 4221001 A1 | 1/1994 |
| EP | 0292409 A1 | 11/1988 |

(Continued)

OTHER PUBLICATIONS

Steven B. Warner, Fiber Science, 1995, Prentice Hall, p. 127 (Year: 1995).*

(Continued)

*Primary Examiner* — Shaun R Hurley
(74) *Attorney, Agent, or Firm* — Moser Taboada

(57) ABSTRACT

A composite yarn is disclosed herein having a plurality of first synthetic fibers having a tenacity of greater than or equal to 1 N/tex; and a plurality of second fibers having a tenacity of less than or equal to 0.95 N/tex; wherein each of the first synthetic fibers and the second fibers are stretch broken and/or cut; and wherein each of the first synthetic (Continued)

fibers and the second fibers have an average length from about 75 mm to about 150 mm. A method of making the composite yarn and articles formed from the composite yarn are also disclosed.

16 Claims, 2 Drawing Sheets

(56) References Cited

U.S. PATENT DOCUMENTS

| | | | | |
|---|---|---|---|---|
| 2003/0074879 | A1 | 4/2003 | Patrick | |
| 2004/0068972 | A1 | 4/2004 | Kanno et al. | |
| 2006/0177656 | A1 | 8/2006 | Kolmes et al. | |
| 2007/0137164 | A1 | 6/2007 | Kolmes et al. | |
| 2008/0085411 | A1 | 4/2008 | Prickett | |
| 2008/0279514 | A1 | 11/2008 | Hurley et al. | |
| 2009/0183296 | A1 | 7/2009 | Hardee et al. | |
| 2009/0301139 | A1 | 12/2009 | Kolmes et al. | |
| 2011/0020645 | A1 | 1/2011 | Nakanishi | |
| 2011/0274903 | A1 | 11/2011 | Stuart et al. | |
| 2011/0300366 | A1 | 12/2011 | Henssen | |
| 2012/0227158 | A1 | 9/2012 | Ashworth et al. | |
| 2013/0118635 | A1 | 5/2013 | Layson et al. | |
| 2014/0075646 | A1 | 3/2014 | Henssen et al. | |
| 2015/0118425 | A1* | 4/2015 | Dapsalmon | D02G 3/442 442/310 |
| 2022/0408864 | A1* | 12/2022 | Tanaka | D03D 15/533 |

FOREIGN PATENT DOCUMENTS

| | | | |
|---|---|---|---|
| EP | 0564331 | A1 | 10/1993 |
| FR | 2868439 | A1 | 10/2005 |
| JP | 2012515857 | A | 7/2012 |
| KR | 100723432 | B1 | 5/2007 |
| KR | 20070107725 | A | 7/2007 |
| KR | 20110091554 | A | 8/2011 |
| WO | WO-2004033773 | A1 | 4/2004 |
| WO | WO-2010060943 | A1 | 6/2010 |

OTHER PUBLICATIONS

Supplementary European Search Report dated Jun. 14, 2017 for Application No. 14857253.0.

Australian Patent Examination Report dated Jun. 19, 2017 for Patent Application No. 2014344785.

Textile Glossary; Celanese Acetate, copyright 2001 (Year: 2001).

Chinese Office Action dated Aug. 11, 2016 for Application No. 201490001140.4 from corresponding Chinese Application with summary from foreign agent, 4 pgs.

UHMWPE Yarn Colored Polyester Glass Fiber, Sunyang International Trading Co. Ltd., MakePolo.com, URL: http://1012662.en.makepolo.com/products/UHMWPE-YARN---COLORED-POLYESTER---GLASS-FIBER-p25080095.html. (last visited Nov. 25, 2014).

* cited by examiner

COMPOSITE YARN

FIELD OF THE INVENTION

This application generally relates to yarns, more particularly to yarns comprising a blend of high tenacity fibers and other fibers, fabrication methods for forming the yarns, and articles produced therefrom.

DESCRIPTION OF THE RELATED ART

Physical properties of yarns used to manufacture apparel and garments for many industries, such as construction, industrial, machining, and food-service, as well as households, are manipulated to protect users from various potential injury situations such as abrasions, cuts, impacts, frostbite, electrostatic discharge, and other physical injuries, fatigue, and environmental factors related to operational environments and weather. Such apparel includes knitted, non-woven, or woven textiles, such as gloves, capes, jackets, suits, overalls, sleeves, and the like. Often, to impart a required level of a particular type of protection, the yarns used to manufacture this apparel may be thick, heavy, stiff, and uncomfortable, resulting in fatigue, particularly when the yarn directly contacts skin, i.e., sleeves and gloves. Textiles for industrial curtains, draperies, and the like also often require various types and levels of protection. For example, gloves and sleeves designed to provide abrasion or cut protection, fire retardation, or insulation against heat or excessive cold, may require thick yarns, formed into fabric having thicker gauge knits, such as 13, 10, and 7 gauge knits, because the denier of yarns used to make gloves having sufficiently high levels of protection and resistance are typically high, for example, higher than 600 denier. Moreover, typical yarns used to provide physical protection are made from stiffer materials and often include high amounts of fillers, for example, 50 weight % or more. Other materials offering various protective properties may also be incorporated into yarns. For example, the protective properties of articles may be augmented by incorporating relatively stiff materials, such as steel or copper wire into the yarns from which they are produced. These materials can be very irritating to the skin of users and are typically inflexible. Moreover, such materials are prohibitively expensive for many service applications.

Forming a glove or a glove liner, or other article, that is thin, flexible, and comfortable, without the use of stiff, thick fibers, while maintaining high levels of various protective properties has not been possible thus far. For example, providing a comfortable, cut and abrasion resistant knitted article, using, for example, a blended 70-600 denier yarn has not heretofore been realized.

Therefore, there is a need for inexpensive yarns offering excellent protective properties as well as comfort and flexibility and methods of producing articles, such as woven and knitted articles, such as gloves, glove liners, sleeves, and curtains from these yarns, representing a significant advance in the art.

SUMMARY

Yarns comprising high tenacity fibers and other fibers, which can be used to manufacture protective articles, such as gloves, glove liners, sleeves, capes, overalls, curtains and the like, are disclosed and shown in connection with at least one of the figures herein. Embodiments disclosed herein are set forth more completely in the claims.

In embodiments, a composite yarn is prepared by blending a plurality of first synthetic fibers having a tenacity of greater than or equal to 1 N/tex; and a plurality of second fibers having a tenacity of less than or equal to 0.95 N/tex; wherein each of the first synthetic fibers and the second fibers are stretch broken and/or cut; and wherein each of the first synthetic fibers and the second fibers have an average length from about 75 mm to about 150 mm.

In embodiments, a method for making a composite yarn comprises spinning a plurality of first synthetic fibers having a tenacity of greater than or equal to 1 N/tex; and a plurality of second fibers having a tenacity of less than or equal to 0.95 N/tex; wherein each of the first synthetic fibers and the second fibers are stretch broken and/or cut; and wherein each of the first synthetic fibers and the second fibers have an average length from about 75 mm to about 150 mm, to form the composite yarn.

Various advantages and features of the present invention will be more fully understood from the following description and drawings.

BRIEF DESCRIPTION OF THE DRAWINGS

It is to be noted that the appended drawings depict embodiments disclosed herein, and are therefore not to be considered limiting of its scope. It is to be understood that elements and features of one embodiment may be in other embodiments without further recitation. It is further understood that, where possible, identical reference numerals have been used to indicate comparable elements that are common to the figures.

DETAILED DESCRIPTION

Figure 1:
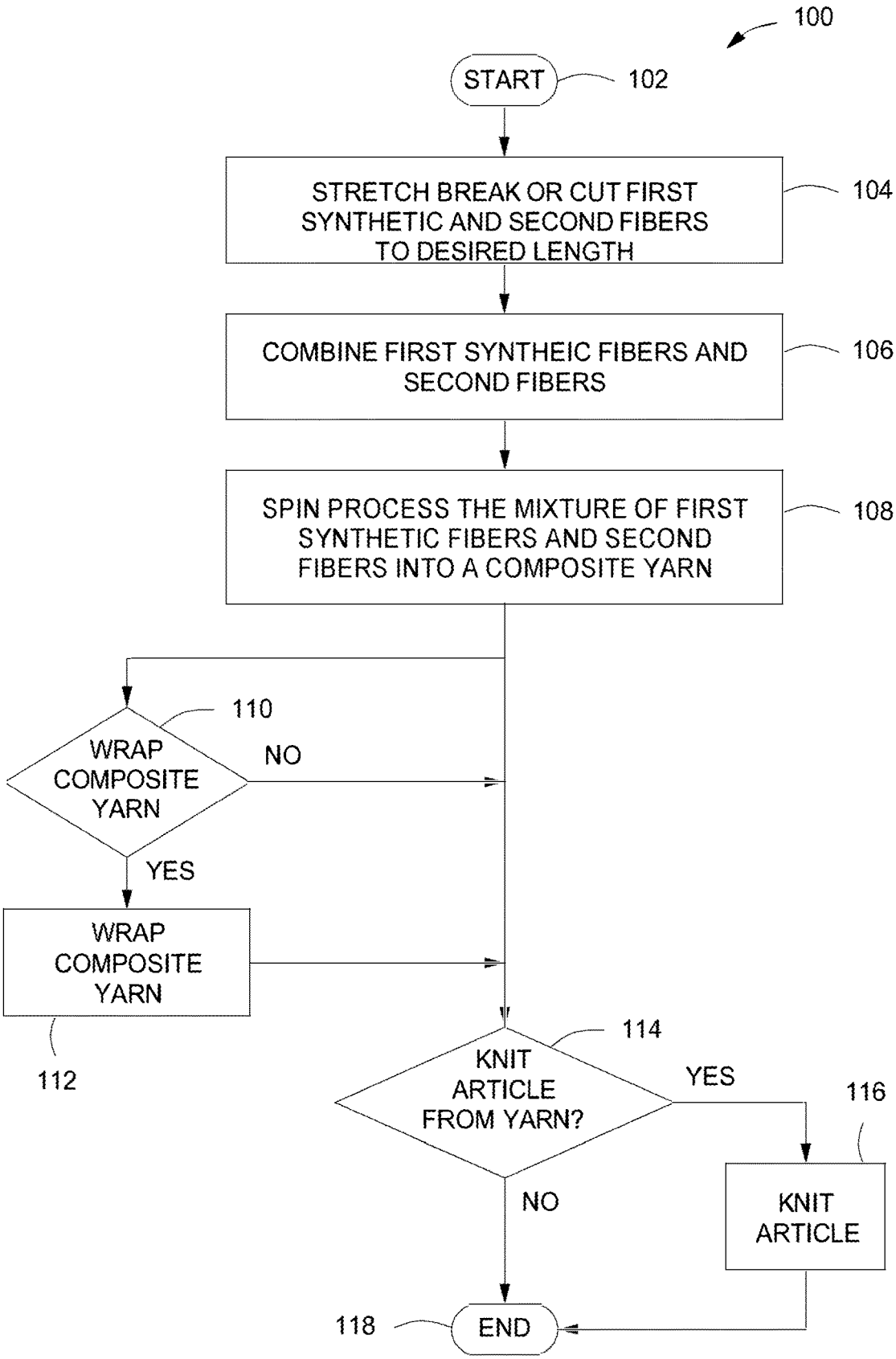
FIG. 1 depicts a flow diagram of a method for producing a composite yarn, according to one or more embodiments disclosed herein.

Embodiments of the present disclosure comprise composite yarns that blend high tenacity synthetic fibers, e.g., a plurality of first synthetic fibers, with a plurality of other fibers, e.g., a plurality of second fibers, to produce yarns having improved physical properties which when formed into articles provide improved protection to the end user. For example, embodiments of the present disclosure comprise composite yarns that blend high tenacity synthetic fibers, e.g., a plurality of first synthetic fibers, with a plurality of other fibers, e.g., a plurality of second fibers, to produce high cut resistant yarns, which can be formed into articles having high abrasion resistance. High tenacity fibers are also referred to in the art as "high performance" fibers, "technical fibers" and the like. Suitable examples of high tenacity fibers include, but are not limited to, chain-extended polyolefin fibers, such as high performance polyethylene (HPPE) and ultra-high molecular weight polyethylene (UHMWPE); reinforced high performance fibers such as reinforced UHMWPE; aramid fibers, for example, para-aramids, meta-aramids; copolyamides; carbon fibers, and combinations thereof, and/or the like. It is to be understood that for purposes herein, the high tenacity synthetic fibers are formed from synthetic means, and are not formed from naturally occurring materials, e.g., glass, metal, or other inorganic materials.

As used herein, a fiber's tenacity generally refers to the strength of a fiber. In particular, tenacity refers to the ability of a fiber to resist breaking or stretching when it is subjected to tension or stress. Tenacity is determined by measuring the amount of force that is required to break a fiber. For purposes herein, high tenacity fibers are characterized as having a tenacity of greater than or equal to about 1 newton/tex (N/tex), when determined according to ASTM Test Method D3822 wherein tex refers to the linear density of the fiber in grams per 1000 meters of the fiber.

The other fibers, e.g., the "second" fibers may comprise synthetic fibers, filament fibers, elastomeric fibers, and/or inorganic, mineral and/or ceramic fibers such as metal fibers, silica fibers, ceramic fibers, basalt fibers, High Tenacity (HT) Nylon, HT Polyester and the like. In embodiments, the second fibers comprise a combination of various fibers. For purposes herein, the second fibers are characterized as having a tenacity of less than or equal to about 0.95 N/tex, when determined according to ASTM Test Method D3822. Accordingly, High Tenacity (HT) Nylon and HT Polyester, while labeled as being high tenacity, possess a tenacity of less than or equal to about 0.95 N/tex, rendering such fibers as being second fibers for purposes herein.

The composite yarns according to embodiments described herein may comprise fibers to counteract the effects of laundering wear, to impart resistance to cold, to impart fire resistance, to impart electrical conductivity, to impart electrostatic discharge properties, and/or to impart comfort. For example, composite yarns according to some embodiments of the invention include nylon fibers and/or elastomeric fibers, to maintain a very thin, moisture regulating, and flexible structure. Moreover, embodiments of the composite yarn may comprise the first and second fibers in the form of a core yarn, which is wrapped with one or more wrapping yarns. In embodiments, the wrapping yarns may comprise a nylon yarn, a polyester yarn, or a combination thereof.

In embodiments, a composite yarn comprises a plurality of first synthetic fibers having a tenacity of greater than or equal to 1 N/tex; and a plurality of second fibers having a tenacity of less than or equal to 0.95 N/tex; wherein each of the first synthetic fibers and the second fibers are stretch broken and/or cut; and wherein each of the first synthetic fibers and the second fibers have an average length from about 75 mm to about 150 mm. In embodiments, the second fibers have a tenacity of less than or equal to 0.5 N/tex. In embodiments, both the first synthetic fibers and the second fibers are stretched broken. In embodiments, both the first synthetic fibers and the second fibers are cut.

In embodiments, the first synthetic fibers are reinforced filament fibers, and/or the first synthetic fibers comprise a filler. In embodiments, the first synthetic fibers comprise para-aramid, meta-aramid, copolyamides, carbon filaments, carbon fibers, high performance polyethylene (HPPE), ultra-high molecular weight polyethylene (UHMWPE), reinforced HPPE, reinforced UHMWPE, or a combination thereof.

In embodiments, the second fibers may comprise cellulosic fibers, vicose (rayon), nylon, acrylic, modacrylic, an elastomer, a polyester, a polyolefin, or a combination thereof.

In embodiments, in addition to the first synthetic high tenacity fibers and the second fibers, the composite yarn may further comprise other fibers such as inorganic fibers, e.g., glass fibers, silica fibers, metal fibers, ceramic fibers, basalt fibers, or a combination thereof. In embodiments, these additional fibers are included to impart particular physical properties into the yarn, e.g., glass fibers to impart fire resistance, and the like.

In embodiments, a weight-to-weight ratio of the first synthetic fibers to the second fibers is from about 10:90 to about 90:10, based on a total amount of the first synthetic fibers and the total amount of the second fibers present.

In embodiments, the composite yarn further comprises at least one wrapping yarn wrapped around the core yarn comprising the first synthetic fibers and the second fibers. In embodiments, the at least one wrapping yarn comprises a polyamide, a polyester, a nylon or a combination thereof. In embodiments, the composite yarn has a denier between 70 and 221.

In embodiments, the composite yarn comprises electrically conductive hairy fibers, each comprising a plurality of appendages extending away from a center of the hairy fiber, wherein a portion of the plurality of appendages extend away from an outer surface of the composite yarn, with or without a wrapping yarn, and wherein the composite yarn has ESD properties, i.e., is capable of electrostatic discharge, prevents the buildup of static electricity, and/or reduces static electric charges by providing electrical conduction, and/or is dissipative, allowing electrical charge flow to ground. In some embodiments, the second fibers comprise the conductive hairy fibers. In some embodiments, hair fibers are present in addition to the first synthetic fibers and the second fibers.

In embodiments, the composite yarn is dimensioned to be knitted with a needle of less than or equal to 18 gauge. In embodiments, the composite yarn is dimensioned to be knitted with a needle from 15 gauge to 18 gauge. In embodiments, the composite yarn is dimensioned to be knitted with a 21-gauge needle.

In embodiments, a knitted article comprising the composite yarn according to embodiments disclosed herein has an EN ISO cut level from B to E, when determined according to EN 388:2016.

In embodiments, the first synthetic fibers have a tenacity of greater than or equal to 1 N/tex, or greater than or equal to about 1.3 N/tex, or greater than or equal to about 1.5 N/tex, or greater than or equal to about 1.8 N/tex, or greater than or equal to about 2.0 N/tex.

In embodiments, the second fibers having a tenacity of less than or equal to 0.95 N/tex, or less than or equal to about 0.9 N/tex, or less than or equal to about 0.8 N/tex, or less than or equal to about 0.7 N/tex, or less than or equal to about 0.6 N/tex, or less than or equal to about 0.5 N/tex.

In embodiments, each of the first synthetic fibers and the second fibers have an average length from about 70 mm to about 150 mm, or from about 80 mm to about 150 mm, or from about 90 mm to about 150 mm.

In embodiments, both the first synthetic fibers and the second fibers are stretched broken such that both the first synthetic fibers and the second fibers have essentially the same length between about 70 mm to about 150 mm.

In embodiments, both the first synthetic fibers and the second fibers are cut such that both the first synthetic fibers and the second fibers have essentially the same length between about 70 mm to about 150 mm.

In embodiments, the first synthetic fibers are stretch broken and the second fibers are cut such that both the first synthetic fibers and the second fibers have essentially the same length between about 70 mm to about 150 mm.

In embodiments, the first synthetic fibers are cut and the second fibers are stretch broken such that both the first synthetic fibers and the second fibers have essentially the same length between about 70 mm to about 150 mm.

In embodiments, the first synthetic fibers are reinforced filament fibers. In embodiments the first synthetic fibers comprise a filler. In embodiments, the fillers comprise inorganic materials, e.g., glass, carbon, silica, basalt, ceramics, and/or the like, or a combination thereof.

In embodiments, the first synthetic fibers comprise para-aramid fibers, and/or meta-aramid fibers. In embodiments, the first synthetic fibers comprise copolyamide fibers, e.g., nylon fibers. In embodiments, the first synthetic fibers comprise carbon filament fibers. In embodiments, the first synthetic fibers comprise high performance polyethylene fibers (HPPE). In embodiments, the HPPE fibers are reinforced HPPE fibers. In embodiments, the first synthetic fibers comprise ultra-high molecular weight polyethylene (UHMWPE) fibers. In embodiments, the first synthetic fibers comprise a mixture of such synthetic fibers. In embodiments, the first synthetic fibers comprise carbon fibers. In embodiments, the second fibers comprise vicose fibers. In embodiments, the second fibers comprise nylon fibers. In embodiments, the second fibers comprise acrylic fibers. In embodiments, the second fibers comprise modacrylic fibers. In embodiments, the second fibers comprise elastomers. In embodiments, the second fibers comprise polyester. In embodiments, the second fibers comprise a polyolefin, which in embodiments the polyolefin comprises polyethylene, polypropylene, polybutene, polyisobutene, or a combination thereof. In embodiments, the second fibers comprise a combination of such fibers.

In embodiments, in addition to the first synthetic fibers and the second fibers, the composite yarn further comprises a third or a combination of other fibers. In embodiments, in addition to the first synthetic fibers and the second fibers, the composite yarn further comprises glass fibers. In embodiments, in addition to the first synthetic fibers and the second fibers, the composite yarn further comprises silica fibers. In embodiments, in addition to the first synthetic fibers and the second fibers, the composite yarn further comprises ceramic fibers. In embodiments, in addition to the first synthetic fibers and the second fibers, the composite yarn further comprises basalt fibers.

In embodiments, a weight-to-weight ratio of the first synthetic fibers to the second fibers is from about 10:90 to about 90:10, based on a total amount of the first synthetic fibers and the second fibers present in the composite yarn. In embodiments, the weight-to-weight ratio of the first synthetic fibers to the second fibers is from about 20:80 to about 80:20, or from about 30:70 to about 70:30, or from about 40:60 to about 60:40, based on a total amount of the first synthetic fibers and the second fibers present in the composite yarn. In an embodiment, a weight-to-weight ratio of the first synthetic fibers to the second fibers is from about 51:49 to about 90:10, based on a total amount of the first synthetic fibers and the second fibers present in the composite yarn.

In embodiments, the amount by weight of the first synthetic fibers to the total amount of both the first synthetic fibers and the second fibers is greater than or equal to about 10 wt %, based on the total amount of the first synthetic fibers and the second fibers present in the yarn. In embodiments, the amount by weight of the first synthetic fibers to the total amount of both the first synthetic fibers and the second fibers is greater than or equal to about 20 wt %, or greater than or equal to about 30 wt %, or greater than or equal to about 40 wt %, or greater than or equal to about 51 wt %, or greater than or equal to about 60 wt %, or greater than or equal to about 70 wt %, or greater than or equal to about 80 wt %, or greater than or equal to about 90 wt %, based on the total amount of the first synthetic fibers and the second fibers present in the yarn.

In embodiments, the composite yarn further comprises at least one wrapping yarn wrapped around the composite core yarn comprising the first synthetic fibers and the second fibers. In embodiments, the at least one wrapping yarn comprises a polyamide. In embodiments, the at least one wrapping yarn comprises at least one polyester. In embodiments, the at least one wrapping yarn comprises at least one nylon. In embodiments, the at least one wrapping yarn comprises a combination of a polyamide and a polyester. In embodiments, two wrapping yarns are wrapped around the core yarn comprising the first synthetic fibers and the second fibers. In embodiments, the two wrapping yarns are wrapped in an opposite orientation relative to one-another.

In embodiments, the composite yarn has a denier of greater than or equal to about 70 and less than or equal to about 221. In embodiments, the composite yarn has a denier of greater than or equal to about 90, or greater than or equal to about 110, or greater than or equal to about 130, or greater than or equal to about 140, or greater than or equal to about 150, greater than or equal to about 160, or greater than or equal to about 175, and less than or equal to about 221 denier.

In embodiments, the composite yarn comprises electrically conductive hairy fibers, each comprising a plurality of appendages extending away from a center of the hairy fiber, wherein a portion of the plurality of appendages extend away from an outer surface of the composite yarn, and wherein the composite yarn has electrostatic discharge properties, wherein an article produced from the composite yarn has a vertical resistivity of less than or equal to about 108 Ohm when determined according to EN 16350, when the article is a glove, or when determined according to EN 1149-5:2018 when the article is a suit or other clothing article. Accordingly, in embodiments, an article produced from the composite yarn has a vertical resistivity of less than or equal to about 108 Ohm when determined according to EN 16350.

In embodiments, the second fibers comprise the conductive hairy fibers. In other embodiments, the composite yarn comprises at least three types of fibers: a plurality of first synthetic fibers having a tenacity of greater than or equal to 1 N/tex; a plurality of second fibers having a tenacity of less than or equal to 0.95 N/tex; and the conductive hairy fibers. Accordingly, in embodiments, the composite yarn comprises the first synthetic fibers, the second fibers, and the conductive hairy fibers.

In embodiments, one or more of the first synthetic fibers and the second fibers, and when present, a plurality of third fibers, a plurality of fourth fibers, and the like, are selected to impart various properties into an article produced from the composite yarn. In embodiments, the various fibers are selected to impart various properties including improving cut levels, providing comfort, insulating, fire retardation, providing electrical conductivity and/or ESD properties, and the like, to the composite yarn. In embodiments, the first synthetic fibers comprise HPPE and/or carbon fibers, and the second fibers comprise nylon. In embodiments, the second fibers are selected to impart insulation properties, e.g., for cold weather conditions, and comprise acrylic and polyester. In embodiments, the various fibers are selected to impart fire retardant properties into the composite yarn, wherein first synthetic fibers comprise meta aramid, and/or para aramid fibers, the second fibers comprise nylon, and the composite yarn further comprises additional glass fibers.

In embodiments, the second fibers comprise acrylic and/or polyester, wherein an article produced from the composite yarn has a contact heat resistance of 1 when determined according to EN407.

In embodiments, the first synthetic fibers comprise meta aramid, and/or para aramid fibers, the second fibers comprise nylon, and the composite yarn further comprises glass fibers, wherein an article produced from the composite yarn has a flame spread value of 1 when determined according to EN407.

In embodiments, the composite yarn is produced by the first synthetic fibers and the second fibers being spun into a blended yarn.

FIG. 1 depicts a flow diagram of a method 100 for producing a composite yarn according to one or more embodiments disclosed herein. In some embodiments, each and every block of the method 100 is performed. In other embodiments, some blocks are omitted or skipped or performed in an order different than that described here. Method 100 starts at process block 102 and proceeds to block 104. At block 104, the first synthetic fibers and the second fibers are stretch broken and/or cut to the desired length. At block 106, the first synthetic fibers and the second fibers, and when present additional types of fibers are combined.

The method 100 proceeds to block 108, at which point the mixture of the first synthetic fibers and the second fibers are spun processed into a composite yarn.

The method 100 next proceeds to block 110, and a decision is made whether to wrap the composite yarn, as a core yarn, with one or more wrapping yarns. If the answer is no, the method proceeds to block 114. If the answer is yes, the method proceeds to block 112 wherein the composite yarn is wrapped with one or more wrapping yarns and then the method proceeds to block 114, where a decision is made to knit an article, e.g., a glove, glove liner, or sleeve, or the like from the composite yarn. If the answer is no, the method 100 ends at block 114. If yes, the method proceeds to block 116 wherein an article is knitted from the composite yarn, for example, using 13, 15, 18, or 21 gauge needles, such as with an automatic knitting machine manufactured by the Shima Seiki, Mfg., Ltd. Co., i.e., Single Whole Garment models, or flat-knitting models or similar knitting machines. The method then ends at block 118. In embodiments, the method 100 may include other blocks, e.g., wherein a polymeric, elastomeric, or latex coating may be optionally disposed on the liner (or sleeve or other article).

Figure 2A:
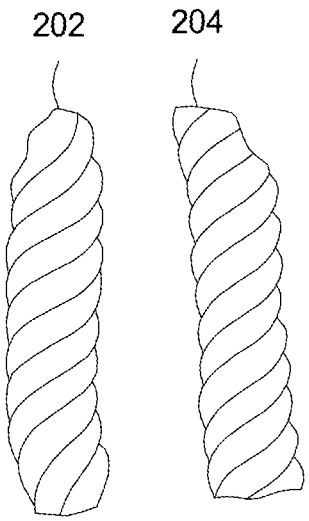
FIGS. 2A-2D depict composite yarns according to embodiments disclosed herein.

FIGS. 2A-2D depict composite yarns according to embodiments disclosed herein. FIG. 2A depicts a composite yarn 202 comprising a plurality of first synthetic fibers having a tenacity of greater than or equal to 1 N/tex; and a plurality of second fibers having a tenacity of less than or equal to 0.95 N/tex; wherein each of the first synthetic fibers and the second fibers are stretch broken and/or cut; and wherein each of the first synthetic fibers and the second fibers have an average length from about 75 mm to about 150 mm. The composite yarn 202 is twisted in a Z-configuration, as shown, during processing. 204 depicts the composite yarn in an S-configuration.

Figure 2B:
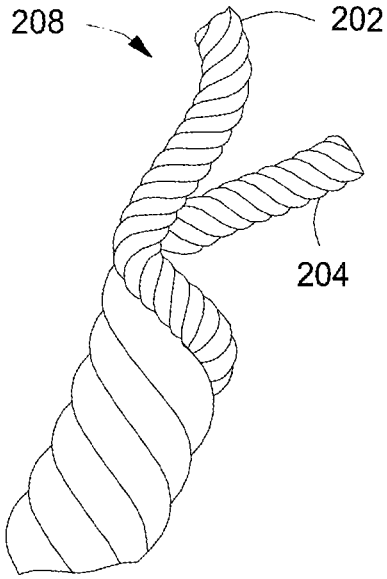

FIG. 2B depicts an example of a two-ply composite yarn 208, which comprises two strands of the composite yarn 202 and 204 twisted together in an S-configuration to form a two-ply composite yarn 208. As discussed above, each of the composite yarns 202 and 204 can comprise many different first synthetic fibers and many different second fibers, and further may independently have the same or different configurations.

Figure 2C:
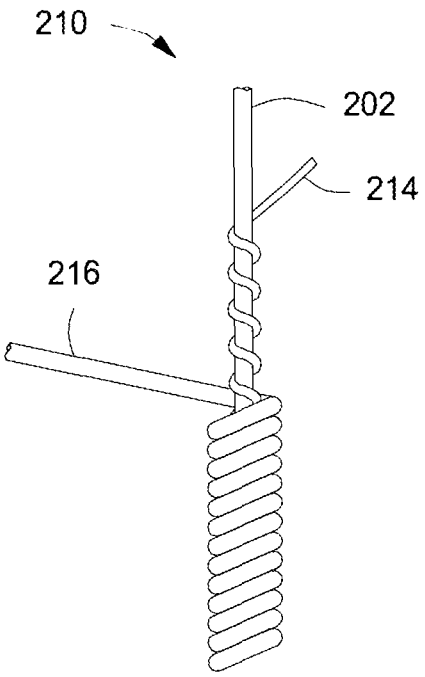

FIG. 2C depicts a wrapped yarn 210 comprising a composite yarn 202, which forms the core yarn, and two wrapping yarns 214 and 216 in accordance with embodiments disclosed herein. As shown in FIG. 2C, in embodiments, the first wrapping yarn 214 and the second wrapping yarn 216 are wrapped in opposite directions. In embodiments, the at least one wrapping yarn is a high tenacity polyester wrapping yarn.

Figure 2D:
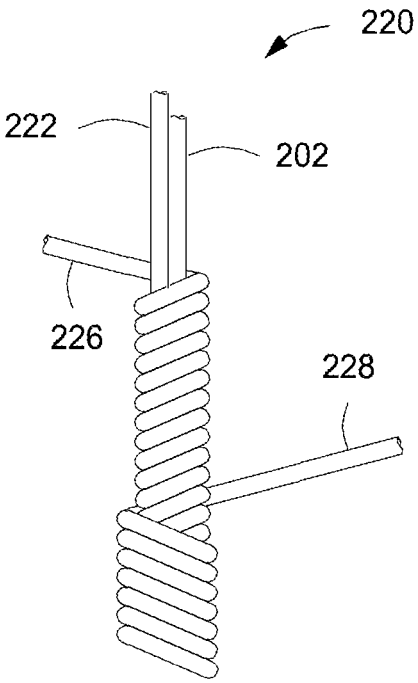

FIG. 2D depicts a four-ply wrapped yarn 220 comprising the composite yarn 202 as a first core yarn, a second core yarn 222, which may also be the composite yarn according to embodiments disclosed herein, and two wrapping yarns 226 and 228. The first core yarn 202 and the second core yarn 222 may be arranged parallel to each other or, alternatively, may be twisted or braided together, and are wrapped by the first wrapping yarn 226 and the second wrapping yarn 228, which in embodiments are wrapped in opposite directions. Any of the first core yarn, and the second core yarn may comprise a plurality of first synthetic fibers having a tenacity of greater than or equal to 1 N/tex; and a plurality of second fibers having a tenacity of less than or equal to 0.95 N/tex; wherein each of the first synthetic fibers and the second fibers are stretch broken and/or cut; and wherein each of the first synthetic fibers and the second fibers have an average length from about 75 mm to about 150 mm, according to embodiments disclosed herein.

In embodiments, any of the wrapping yarns may comprise the first wrapping yarn 226, and second wrapping yarn 228 may comprise a plurality of first synthetic fibers having a tenacity of greater than or equal to 1 N/tex; and a plurality of second fibers having a tenacity of less than or equal to 0.95 N/tex; wherein each of the first synthetic fibers and the second fibers are stretch broken and/or cut; and wherein each of the first synthetic fibers and the second fibers have an average length from about 75 mm to about 150 mm, according to embodiments disclosed herein.

Knitted articles in accordance with embodiments disclosed herein may comprise a coating to form, for example, supported gloves or compression sleeves. For example, a supported glove comprises a polymeric, elastomeric, or latex composition disposed as a layer onto a fabric glove liner, and may be coated either on the outside or inside (skin-contacting) surface with the polymeric, elastomeric, or latex composition. The elastomeric composition comprises natural rubber latex or synthetic rubber latex, as well as other elastomeric polymer materials, for example, but not limited to, natural or synthetic polyisoprene, carboxylated or non-carboxylated acrylonitrile butadiene, nitrile, nitrile-butadiene, polychloroprene, polyvinyls, butyl latex, styrene-butadiene (SBR), styrene-butadiene latex, styrene-isoprene-styrene (SIS), styrene-ethylene/butylene-styrene (SEBS), styrene-acrylonitrile (SAN), polyethylene-propylene-diene, water- or solvent-based polyurethane, anionically stabilized polymer composition, and the like, or mixtures or blends thereof. The polymeric, elastomeric, or latex composition also comprises other additives, fillers, processing aids, vulcanizing agents, rubber accelerators, aqueous and non-aqueous solutions, coagulants, colorants, and the like as known to those in the art.

In some embodiments of the invention, the polymeric composition is foamed, so that air cells dispersed in the range of 5-50 volumetric percentage are formed. When the composition is disposed on a former as a coating, closed cells or open cells may be formed. Foamed polymeric latex layers may penetrate half or more of the thickness of the knitted liner, though the polymeric layer does not penetrate the entire thickness, thereby substantially avoiding strike-through, i.e., skin contact with the polymeric latex. The foamed latex emulsion gels due to the action of the coagulant resident on the surfaces of the yarns forming chocking regions between the fibers, preventing further entry of the foamed latex emulsion into the knitted liner, thus preventing strike-through.

As described herein, a glove is defined as any five-fingered article that is worn on the hand, for example, a supported glove or an unsupported glove. A supported glove is a fabric liner having a polymeric or elastomeric coating disposed thereon. A liner is defined as, for example, a fabric glove (whether woven, non-woven, or knitted) having no elastomeric or polymeric composition disposed thereon, i.e., an unsupported glove. The terms glove and liner may be used interchangeably herein. Likewise, a supported article includes any woven, non-woven, or knitted article, such as a sleeve, having an elastomeric composition disposed thereon.

Although a few exemplary embodiments of the invention have been described in detail above, those skilled in the art will appreciate that many modifications are possible in embodiments without materially departing from the teachings disclosed herein. Any and all such modifications are intended to be included within the embodiments of the invention, and other embodiments may be devised without departing from the scope thereof, and the scope thereof is determined by the following claims.

The invention claimed is:

1. A composite yarn, comprising:

a plurality of first synthetic fibers having a tenacity of greater than or equal to 1 N/tex; and a plurality of second fibers having a tenacity of less than or equal to 0.95 N/tex;

wherein each of the first synthetic fibers and the second fibers are stretch broken to have an average length from about 75 mm to about 150 mm;

wherein the first synthetic fibers comprise para-aramid, meta-aramid, copolyamides, carbon fibers, HPPE, UHMWPE, reinforced HPPE, reinforced UHMWPE, or a combination thereof; and wherein the second fibers comprise elastomers, viscose, nylon, acrylic, modacrylic, a polyester, a polyolefin, silica fibers, ceramic fibers, basalt fibers, metal fibers, glass fibers, or a combination thereof.

2. The composite yarn of claim 1, wherein the second fibers have a tenacity of less than or equal to 0.5 N/tex.

3. The composite yarn of claim 1, wherein the first synthetic fibers are reinforced filament fibers.

4. The composite yarn of claim 1, wherein a weight-to-weight ratio of the first synthetic fibers to the second fibers is from about 10:90 to about 90:10, based on a total amount of the first synthetic fibers and the second fibers present.

5. The composite yarn of claim 1, further comprising at least one wrapping yarn wrapped around a core yarn comprising the first synthetic fibers and the second fibers.

6. The composite yarn of claim 5, wherein the at least one wrapping yarn comprises a polyamide, a polyester, a nylon or a combination thereof.

7. The composite yarn of claim 1, having a denier between 70 and 221.

8. A composite yarn, comprising:

a plurality of first synthetic fibers having a tenacity of greater than or equal to 1 N/tex; and a plurality of second fibers having a tenacity of less than or equal to 0.95 N/tex;

wherein each of the first synthetic fibers and the second fibers are stretch broken and/or cut;

wherein each of the first synthetic fibers and the second fibers have an average length from about 75 mm to about 150 mm; and wherein the composite yarn further comprises electrically conductive hairy fibers, each comprising a plurality of appendages extending away from a center of the hairy fiber, wherein a portion of the plurality of appendages extend away from an outer surface of the composite yarn, wherein an article produced from the composite yarn has a vertical resistivity of less than or equal to about $10^8$ Ohm when determined according to EN 16350, wherein the second fibers comprise the conductive hairy fibers, and/or wherein the composite yarn comprises the first synthetic fibers, the second fibers, and the conductive hairy fibers.

9. A composite yarn, comprising:

a plurality of first synthetic fibers having a tenacity of greater than or equal to 1 N/tex; and a plurality of second fibers having a tenacity of less than or equal to 0.95 N/tex;

wherein each of the first synthetic fibers and the second fibers are stretch broken and/or cut;

wherein each of the first synthetic fibers and the second fibers have an average length from about 75 mm to about 150 mm; and wherein the second fibers comprise acrylic and/or polyester, wherein an article produced from the composite yarn has a contact heat resistance of 1 when determined according to EN407.

10. The composite yarn of claim 1, wherein the first synthetic fibers comprise meta aramid, and/or para aramid fibers, the second fibers comprise nylon, and glass fibers, wherein an article produced from the composite yarn has a flame spread value of 1 when determined according to EN407.

11. The composite yarn of claim 1, dimensioned to be knitted with a needle from 15 gauge to 18 gauge.

12. The composite yarn of claim 1, dimensioned to be knitted with a 21 gauge needle.

13. A method for making the composite yarn of claim 1, comprising:

spinning a plurality of the first synthetic fibers and a plurality of the second fibers to form the composite yarn.

14. The method of claim 13, further comprising wrapping at least one wrapping yarn around a core yarn comprising the first synthetic fibers and the second fibers to form the composite yarn.

15. A knitted article comprising the composite yarn of claim 1.

16. The knitted article of claim 15, having an EN ISO cut level from B to E, when determined according to EN 388:2016.

* * * * *